US007874559B1

(12) United States Patent
Tseng

(10) Patent No.: US 7,874,559 B1
(45) Date of Patent: Jan. 25, 2011

(54) PLAYING CARD DISPENSING AND OPENING SYSTEM

(76) Inventor: Tzu-Hsiang Tseng, 15/F., No. 367, Hankou Rd., Sec. 4, Taichung City (TW)

( * ) Notice: Subject to any disclaimer, the term of this patent is extended or adjusted under 35 U.S.C. 154(b) by 0 days.

(21) Appl. No.: 12/461,357

(22) Filed: Aug. 10, 2009

(51) Int. Cl.
*A63F 1/12* (2006.01)

(52) U.S. Cl. ..... 273/149 R

(58) Field of Classification Search ..... 273/149 R
See application file for complete search history.

(56) References Cited

U.S. PATENT DOCUMENTS 4,257,291 A * 3/1981 Buchmann ..... 83/76.1
5,228,469 A * 7/1993 Otten et al. ..... 137/80
5,382,024 A * 1/1995 Blaha ..... 273/149 R
5,584,483 A * 12/1996 Sines et al. ..... 273/149 R
5,683,085 A * 11/1997 Johnson et al. ..... 273/149 R
6,039,650 A * 3/2000 Hill ..... 463/47
6,126,166 A * 10/2000 Lorson et al. ..... 273/148 R
6,254,096 B1 * 7/2001 Grauzer et al. ..... 273/149 R
6,588,751 B1 * 7/2003 Grauzer et al. ..... 273/149 R
7,137,627 B2 * 11/2006 Grauzer et al. ..... 273/149 R
7,234,698 B2 * 6/2007 Grauzer et al. ..... 273/149 R
7,255,344 B2 * 8/2007 Grauzer et al. ..... 273/149 R
7,523,937 B2 * 4/2009 Fleckenstein ..... 273/149 R
2004/0224777 A1 * 11/2004 Smith et al. ..... 463/47
2005/0148391 A1 * 7/2005 Tain ..... 463/42
2007/0069462 A1 * 3/2007 Downs et al. ..... 273/149 R
2009/0289414 A1 * 11/2009 Bergman et al. ..... 273/149 R

* cited by examiner

*Primary Examiner*—Alvin A Hunter
*Assistant Examiner*—Dolores Collins
(74) *Attorney, Agent, or Firm*—Rosenberg, Klein & Lee

(57) ABSTRACT

A playing card dispensing and opening system includes a playing card dispensing unit that dispenses playing cards automatically, and a playing card opening unit that uses a motor to rotate a crank arm and to further move a transparent playing card holder plate from a horizontal position for receiving a dispensed playing card from the playing card dispensing unit to a vertical position to show the card suit and card value of the received playing card and then to a tilting position to let the received playing card fall from the transparent playing card holder plate to a playing card return slot on the table supporting the system.

2 Claims, 4 Drawing Sheets

PLAYING CARD DISPENSING AND OPENING SYSTEM

BACKGROUND OF THE INVENTION

1. Field of the Invention

The present invention relates to playing card dispensers and more particularly, to a playing card dispensing and opening system that automatically dispenses playing cards and opens each dispensed playing card.

2. Description of the Related Art

Conventional playing card dispensers include two types. A first type of playing card dispenser is known comprising a chute having a chute for holding a deck of playing cards, and a motor drive controllable to rotate a card-dispensing roller in dispensing playing cards out of the chute. This design of playing card dispenser simply dispenses playing cards. The dealer needs to open each dispensed playing card, or a complicated and expensive mechanical arm shall be used to open each dispensed playing card. A second type of playing card dispenser is known comprising a shoe for holding a deck of playing cards and a mechanical arm for picking up playing cards from the shoe and opening each playing card immediately after removal from the shoe. A playing card of the second type does not simulate dealing of cards by a dealer.

SUMMARY OF THE INVENTION

The present invention has been accomplished under the circumstances in view. It is one object of the present invention to provide a playing card dispensing and opening system, which automatically dispenses playing cards and automatically opens each dispensed playing card, simulating dealing of playing cards by a human being and avoiding direct contact of the playing cards by the dealer to prevent cheating.

To achieve this and other objects of the present invention, a playing card dispensing and opening system comprises a playing card dispensing and opening system comprising playing card dispensing unit for dispensing playing cards and a playing card opening unit for opening each playing card dispensed by the playing card dispensing unit. The playing card opening unit comprises a motor mount affixed to one lateral side of the playing card dispensing unit, a motor mounted on the motor mount, a crank arm connected to the output shaft of the motor, and a transparent playing card holder plate fastened to one end of the crank arm opposite to the motor and movable by the motor through the crank arm from a horizontal position for receiving a playing card dispensed by the playing card dispensing unit to a vertical position for showing the card suit and card value of the received playing card and then to a tilting position for letting the received playing card fall from the transparent playing card holder plate.

DETAILED DESCRIPTION OF THE PREFERRED EMBODIMENT

Figure 1:
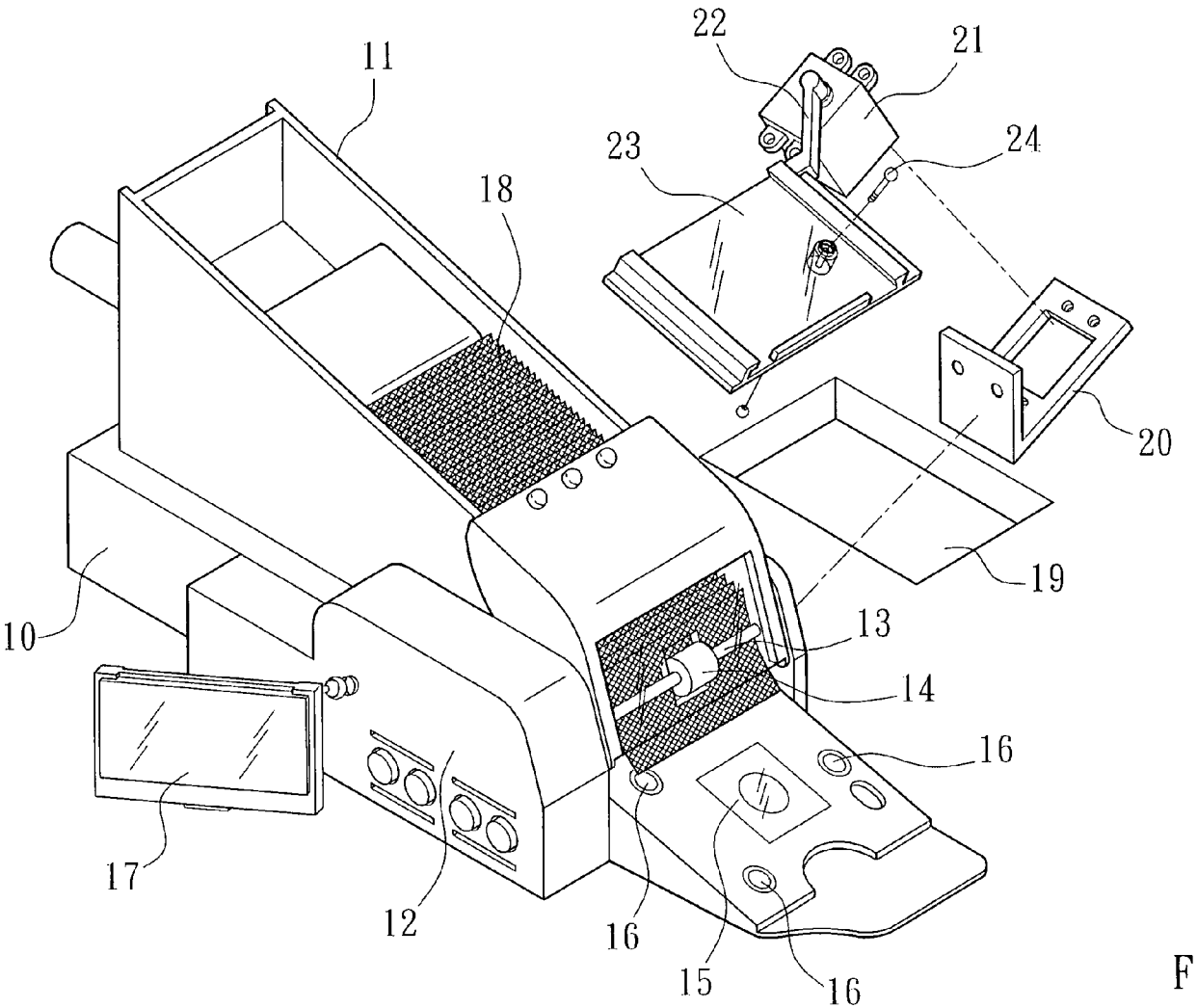
FIG. 1 is an exploded view of a playing card dispensing and opening system according to the present invention.
Figure 2:
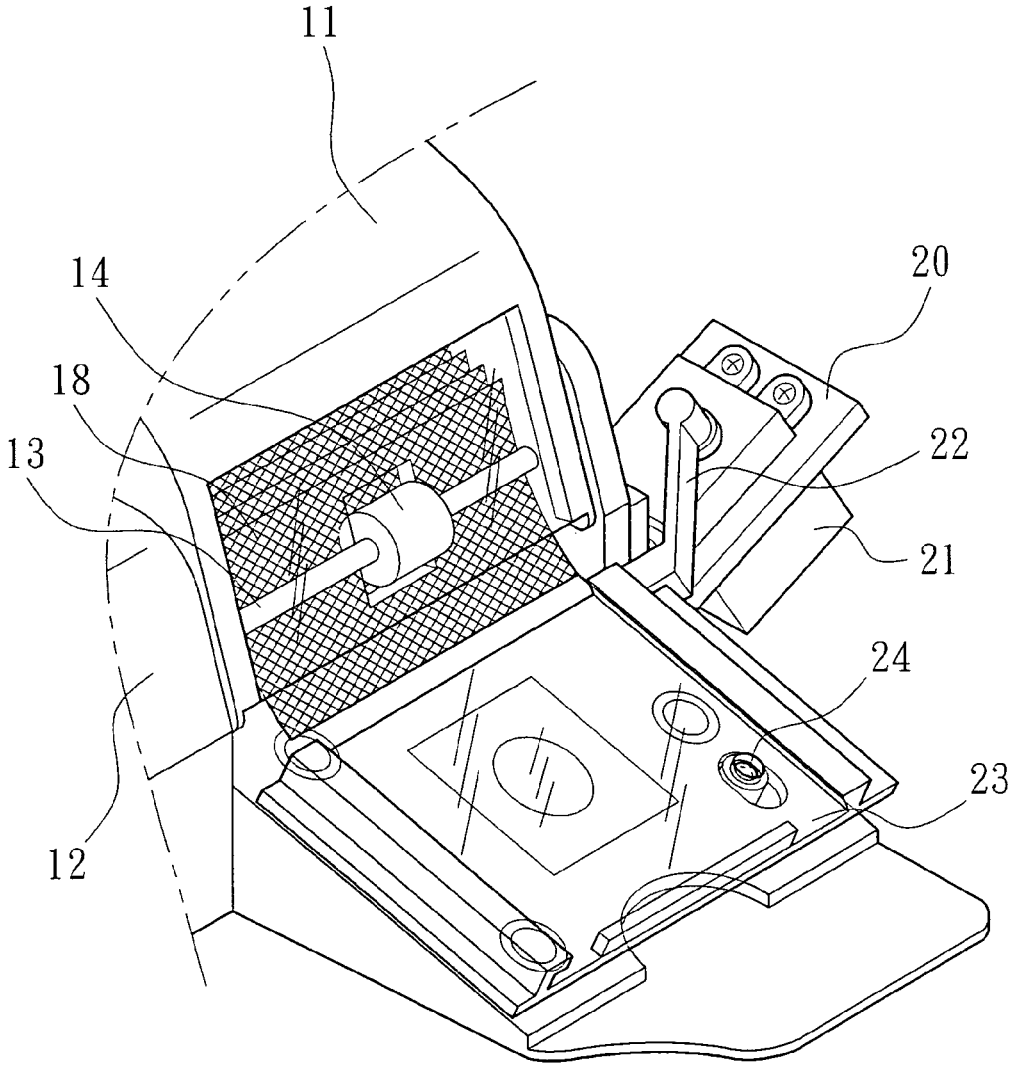
FIG. 2 is a perspective view in an enlarged scale of a part of the playing card dispensing and opening system shown in FIG. 1.
Figure 3:
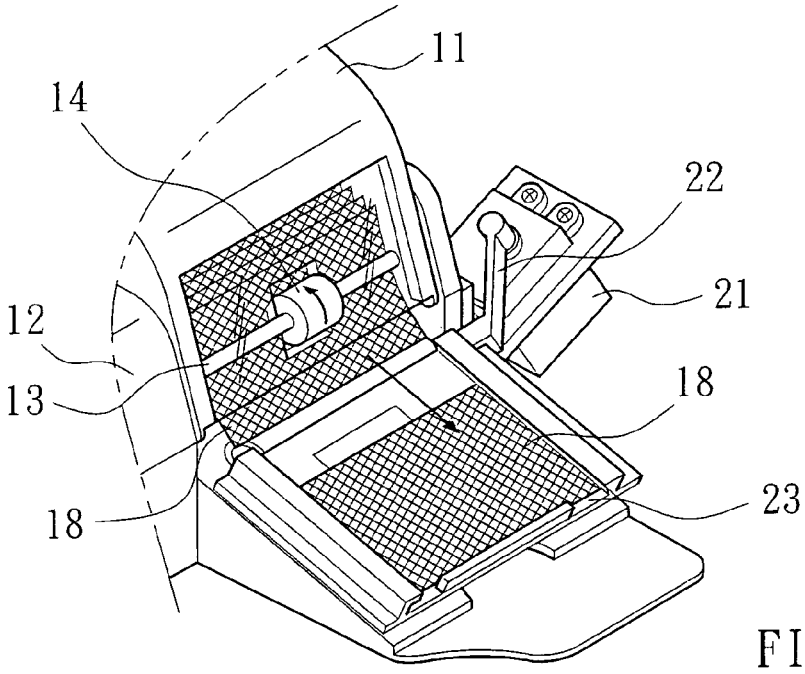
FIG. 3 is a schematic drawing showing the operation of the playing, card dispensing and opening system according to the present invention (I).

Referring to FIGS. 1 and 2, a playing card dispensing and opening system in accordance with the present invention is shown comprising a housing 10 having a chute 11 for holding a deck of playing cards 18, a scanner 15 and infrared sensors 16 arranged in front of the sloping output port of the chute 11, a driver unit 12 provided at one lateral side of the housing 10, a display 17 provided at one lateral side of the housing 10 at a suitable location, a motor mount 20 affixed to one lateral side of the housing 10, a motor 21 mounted on the motor mount 20, a crank arm 22 connected to the output shaft of the motor 21, a transparent playing card holder plate 23 fastened to one end of the crank arm 22 opposite to the motor 21, and an ejector rod 24 slidably mounted on the transparent playing card holder plate 23. The driver unit 12 is controllable to rotate a wheel axle 13 and a rubber dispensing wheel 14 on the wheel axle 13. The wheel axle 13 is transversely pivotally mounted in the sloping output port of the chute 11. The rubber dispensing wheel 14 is rotatable with the wheel axle 13 to dispense the playing cards 18. When started the driver unit 12, playing cards 18 are delivered out of the chute 11 in proper order. When one playing card 18 is moved over the scanner 15, the scanner 15 recognizes the card suit and card value of the playing card 18, and gives a signal to the display 17 for displaying the card suit and card value of the playing card 18.

Figure 4:
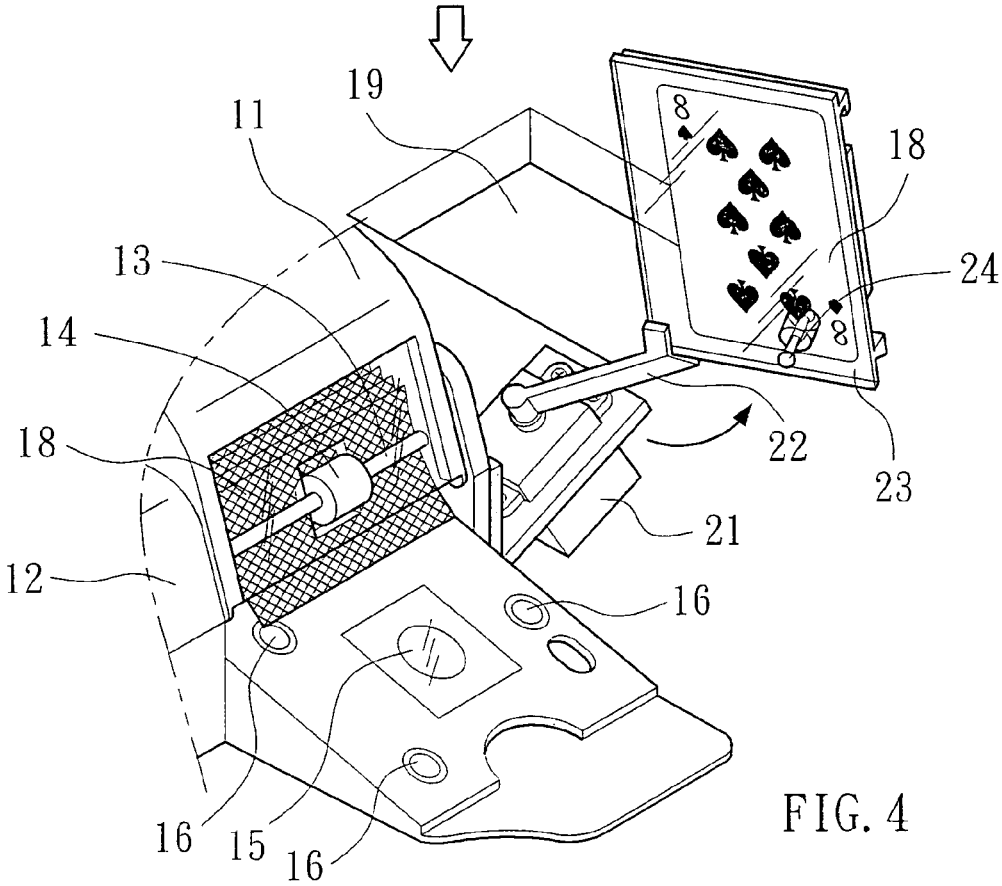
FIG. 4 is a schematic drawing showing the operation of the playing card dispensing and opening system according to the present invention (II).
Figure 5:
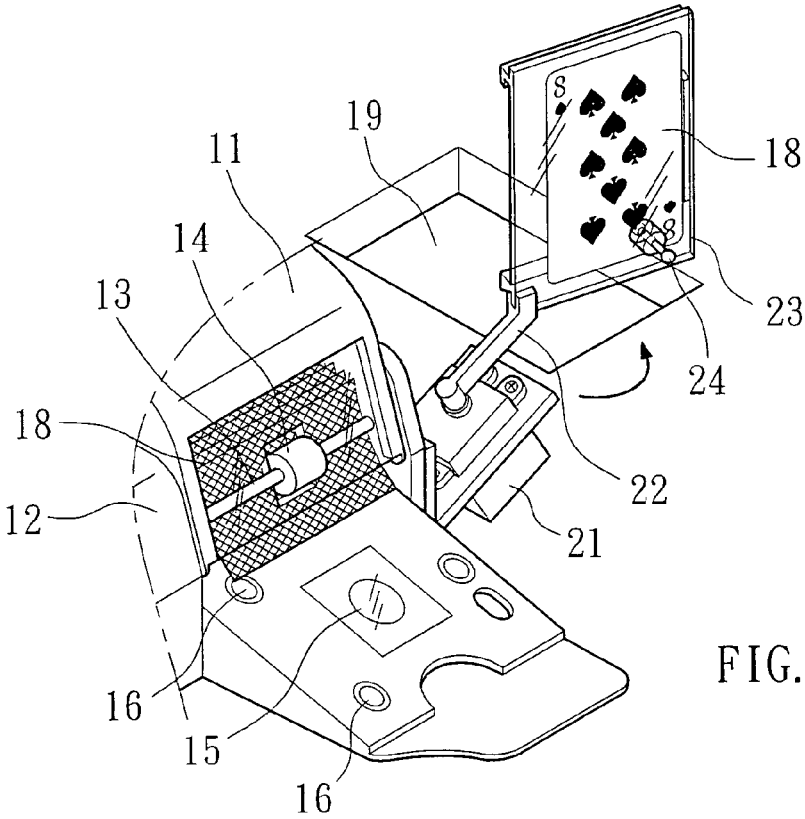
FIG. 5 is a schematic drawing showing the operation of the playing card dispensing and opening system according to the present invention (III).
Figure 6:
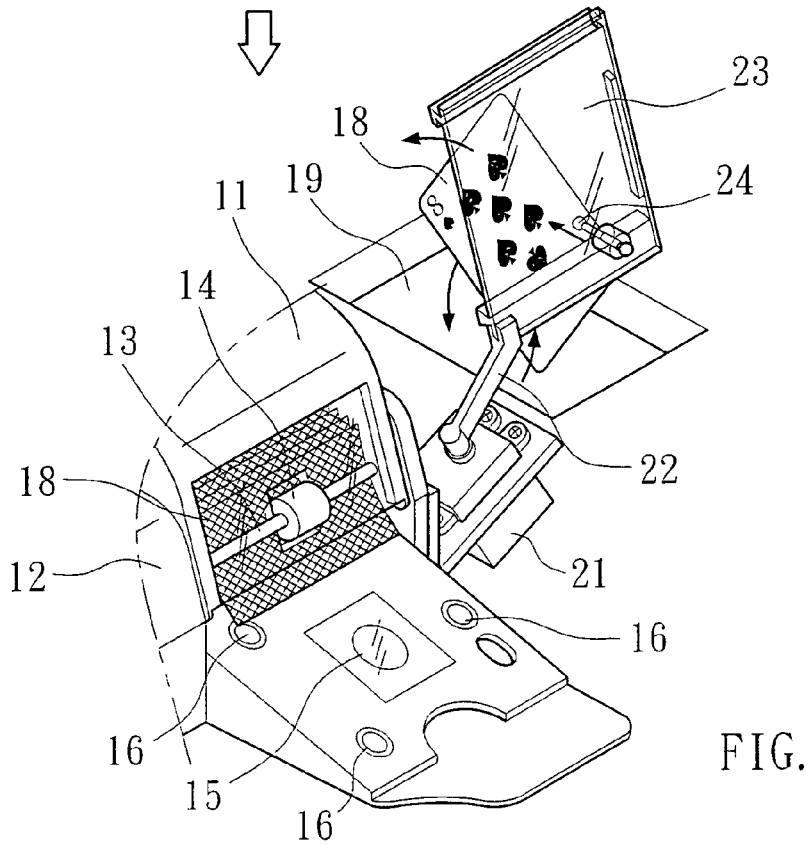
FIG. 6 is a schematic drawing showing the operation of the playing card dispensing and opening system according to the present invention (IV).

Referring to FIGS. 3 through 6, when the motor drive 12 is started to rotate the wheel axle 13, the rubber dispensing wheel 14 is rotated with the wheel axle 13 to dispense the playing cards 18. When one playing card 18 is delivered out of the chute 11, it is moved into the transparent playing card holder plate 23 that is rested on the scanner 15. At this time, the scanner 15 recognizes the card suit and card value of the playing card 18 and gives a signal to the display 17, driving the display 17 to display the card suit and card value of the duly dispensed playing card 18, however nobody can see the card suit and card value of the playing card 18 directly (see FIG. 3). Thereafter, as shown in FIG. 4 and FIG. 5, the motor 21 is started to rotate the crank arm 22 through a predetermined angle, moving the transparent playing card holder plate 23 and the received playing card 18 away from the housing 10 and turning the transparent playing card holder plate 23 from a horizontal position rested on the scanner 15 to a vertical position far from the housing 10 for enabling every body to see the card suit and card value of the dispensed playing card 18. Thereafter, as shown in FIG. 6, the motor 21 is controlled to rotate the crank arm 22 further through an angle, tilting the transparent playing card holder plate 23 and the ejector rod 24 and causing the ejector rod 24 to push the dispensed playing card 18 away from the transparent playing card holder plate 23 to a return slot 19 on the table that supports playing card dispensing and opening system.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A playing card dispensing and opening system comprising playing card dispensing unit for dispensing playing cards and a playing card opening unit for opening each playing card dispensed by said playing card dispensing unit, wherein said playing card opening unit comprises a motor mount affixed to one lateral side of said playing card dispensing unit, a motor mounted on said motor mount, a crank arm connected to an output shaft of said motor, and a transparent playing card holder plate fastened to one end of said crank arm opposite to said motor and movable by said motor through said crank arm from a horizontal position for receiving a playing card dispensed by said playing card dispensing unit to a vertical position for showing the card suit and card value of the received playing card and then to a tilting position for letting the received playing card fall from said transparent playing card holder plate.

2. The playing card dispensing and opening system as claimed in claim 1, wherein said transparent playing card holder plate has an ejector rod slidably mounted thereon, said ejector rod being tilted to force the received playing card out of said transparent playing card holder plate when said transparent playing card holder plate is moved to said tilting position.

* * * * *